US006050050A

United States Patent [19]

Daul et al.

[11] Patent Number: 6,050,050

[45] Date of Patent: Apr. 18, 2000

[54] FORM IN-PLACE SUBMERSIBLE PUMP CONTAINMENT

[75] Inventors: Charles M. Daul, Libertyville; Paul A. Sivak, Compton; David Lyzinski, Wheaton; Albert J. Kovach, Sugar Grove, all of Ill.

[73] Assignee: BP Amoco Corporation, Chicago, Ill.

[21] Appl. No.: 09/000,891

[22] Filed: Dec. 30, 1997

Related U.S. Application Data

[60] Provisional application No. 60/034,120, Dec. 31, 1996.

[51] Int. Cl.[7] ..... E02D 29/14; B65D 90/24

[52] U.S. Cl. ..... 52/741.12; 52/19; 52/20; 52/21; 52/169.6; 52/169.7; 405/52; 405/55; 141/86; 137/312

[58] Field of Search ..... 52/741.12, 19, 52/20, 21, 169.6, 169.7; 405/52, 55; 141/86; 137/312

[56] References Cited

U.S. PATENT DOCUMENTS

| | | | |
|---|---|---|---|
| 3,429,473 | 2/1969 | Vroman et al. . | |
| 3,672,103 | 6/1972 | Kost | 52/20 |
| 3,972,440 | 8/1976 | Warren | 220/484 |
| 4,335,740 | 6/1982 | Boley | 137/364 |
| 4,593,714 | 6/1986 | Madden | 137/371 |
| 4,706,718 | 11/1987 | Milo | 141/86 |
| 4,762,440 | 8/1988 | Argandona | 405/52 |
| 4,842,443 | 6/1989 | Argandona | 405/52 |
| 4,921,115 | 5/1990 | Fields, III | 405/55 |
| 5,037,239 | 8/1991 | Olsen et al. | 405/128 |
| 5,722,204 | 3/1998 | Stieb et al. | 52/20 |

*Primary Examiner*—Carl D. Friedman
*Assistant Examiner*—Jennifer I. Thissell
*Attorney, Agent, or Firm*—Robert A. Yesukevich; Frank J. Sroka

[57] ABSTRACT

A method of upgrading an existing unprotected submersible pump area with secondary containment to prevent accidental release of harmful materials from contaminating the soil below grade.

6 Claims, 5 Drawing Sheets

FORM IN-PLACE SUBMERSIBLE PUMP CONTAINMENT

CROSS REFERENCE TO RELATED APPLICATIONS

This application claims the benefit of U.S. Provisional Appplication Ser. No. 60/034,120, filed Dec. 31, 1996.

FIELD OF THE INVENTION

The invention relates to upgrading unprotected submersible pumps that currently do not have spill containment with a form in-place containment sump to prevent environmental contamination.

BACKGROUND OF THE INVENTION

Most submersible pumps located at service stations or other fueling areas are set into the underground storage tank and the pump head and associated piping and electrical fittings are then exposed to the ground without secondary containment, as shown in FIG. 1. This area is unprotected and any accidental releases will directly result in contamination of soil and/or groundwater.

A secondary containment system is a system that collects and contains fluids that leak out of another and primary containment system. For example, a primary containment system may store, pump and deliver hydrocarbon fuels, such as gasoline and diesel oil, at a fueling station. A secondary containment system collects and contains that same fuel if a primary tank, pump or delivery pipe should rupture or otherwise spill the gasoline. A secondary containment system also catches fuel that spills when a fill tube runs over while a fuel storage tank is being filled, for example. While the invention is described hereinafter in connection with a hydrocarbon fuel filling station storage and delivery system, it should be understood that the invention may also be used to protect any other suitable primary containment system.

With the advent of more stringent environmental regulation, it is important to attempt to contain any fuel spillage and prevent passage of such spillage to the ground, where absorption can require removal an treatment of the contaminated ground material. Hence, it is highly desirable to provide a secondary containment system for spillage from a submersible pump.

SUMMARY OF THE INVENTION

The invention involves a two step process to upgrade the submersible pump area in a manner that will prevent releases from entering the soil. The first step entails forming the sidewalls of the in-place containment sump using fiberglass panels cut from the appropriate diameter pipe as shown in FIG. 2. The fiberglass panels are placed in the existing sump and fastened together to form a tank-like structure. This tank-like structure is formed with a small annular space between it and the existing sump to allow water that enters to drain to the ground.

The second step involves completing the sump by pouring a flexible floor as shown in FIG. 4. A water resistant lid assembly is put in place below grade level to keep water out of the newly formed containment sump.

DETAILED DESCRIPTION OF THE PREFERRED EMBODIMENT

Figure 1:
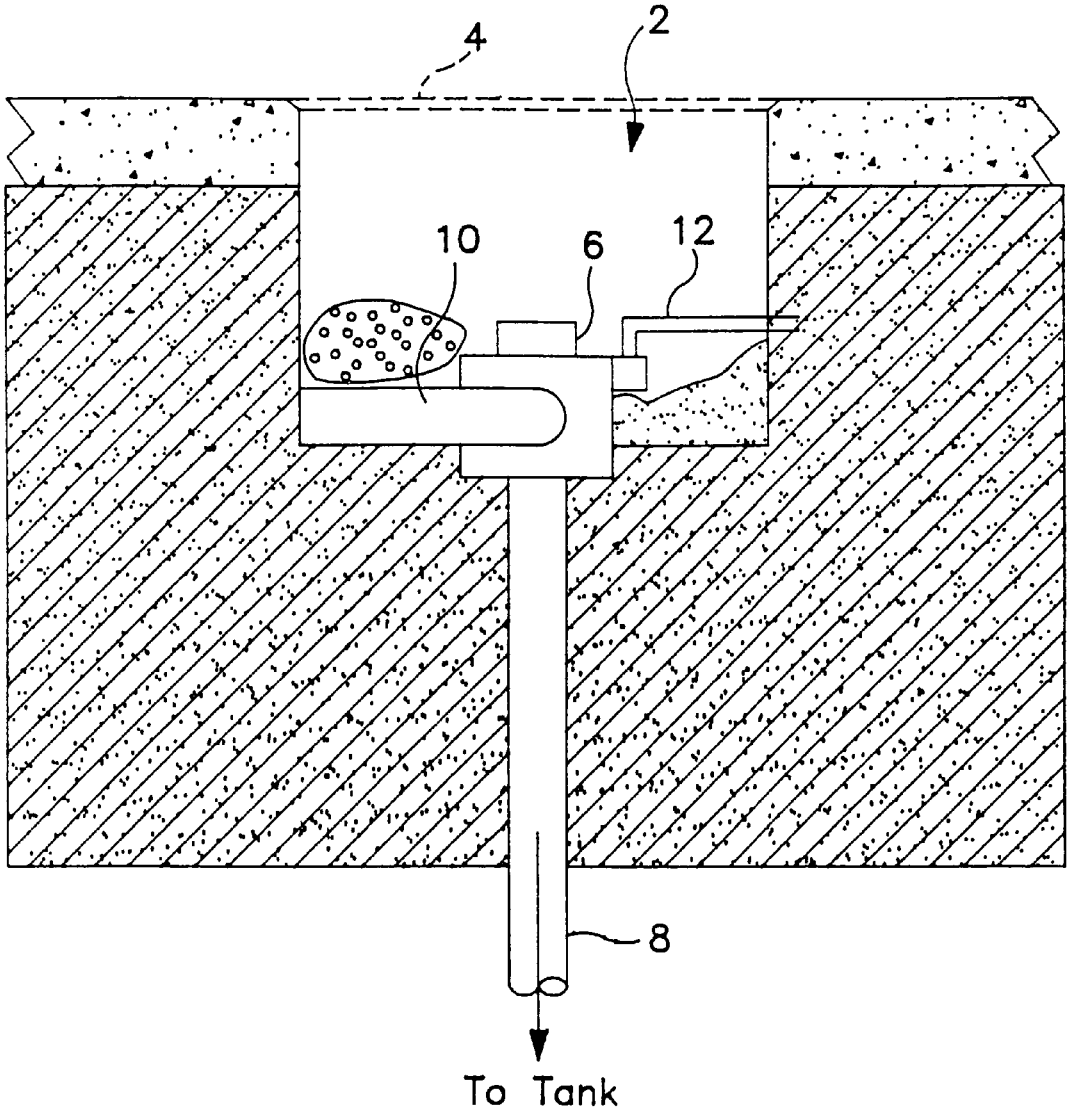
FIG. 1 shows a cut away view of a typical submersible pump area.

Referring to the drawings, wherein reference characters designate like or corresponding parts throughout the views, FIG. 1 shows a cut away view of a typical submersible pump sump area 2 that has no secondary containment. An access or manhole 4 is either round or square and can vary in size typically from 18 to 48 inches in diameter and 6 to 84 inches deep. A submersible pump head 6 can be exposed above the ground, above the backfill, or buried either partially or completely. A pump head supply line 8 connects an inlet of the pump head 6 to an outlet of a supply tank in which the remainder of an associated supply pump resides (not shown.) A submersible pump discharge line 10 connects an outlet of the pump head 4 with corresponding fuel dispensers (not shown.) An electrical power supply line 12 connects the pump head 4 to an electrical power source (not shown.)

The invention comprises a series of steps to form a secondary containment system within the sump area 2. The first step is to remove enough soil or gravel from the existing submersible pump sump area 2 to expose the pump head 6 and at least a portion of the pump supply line 8. The second step is to clean and scrape loose rust, scale and dirt away from the pump supply line 8 and the pump discharge line 10.

Figure 2:
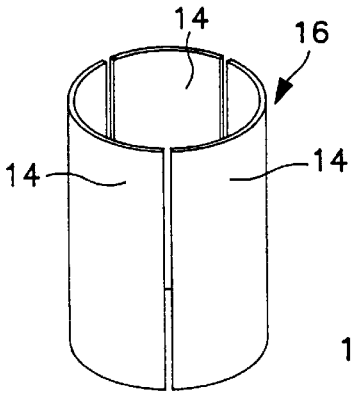
FIGS. 2 through 6 show how the fiberglass panels can be cut and reassembled to form the sidewalls of the new secondary containment system for the sump.
Figure 3:
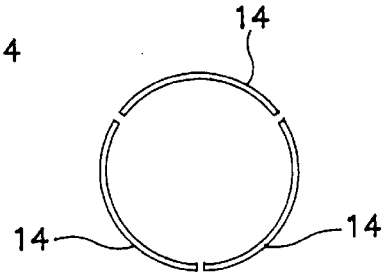

The next step is to fabricate the secondary containment sidewall panels, as shown in FIGS. 2 through 6. FIG. 2 and three show how fiberglass panels 14 can be cut from a suitable diameter gasoline and hydrocarbon resistant pipe section 16 and reassembled to form the sidewalls of the new sump. The pipe section 16 is typically 0.125 to 0.25 inch thick fiberglass reinforced plastic (FRP) with a diameter in the range of 18 to 48 inches and a length of 6 to 84 inches, determined by the size of the sump area 2.

Figure 4:
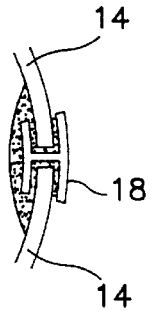
Figure 5:
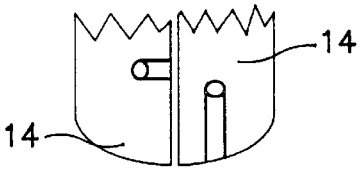
Figure 6:
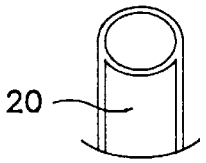
Figure 8:
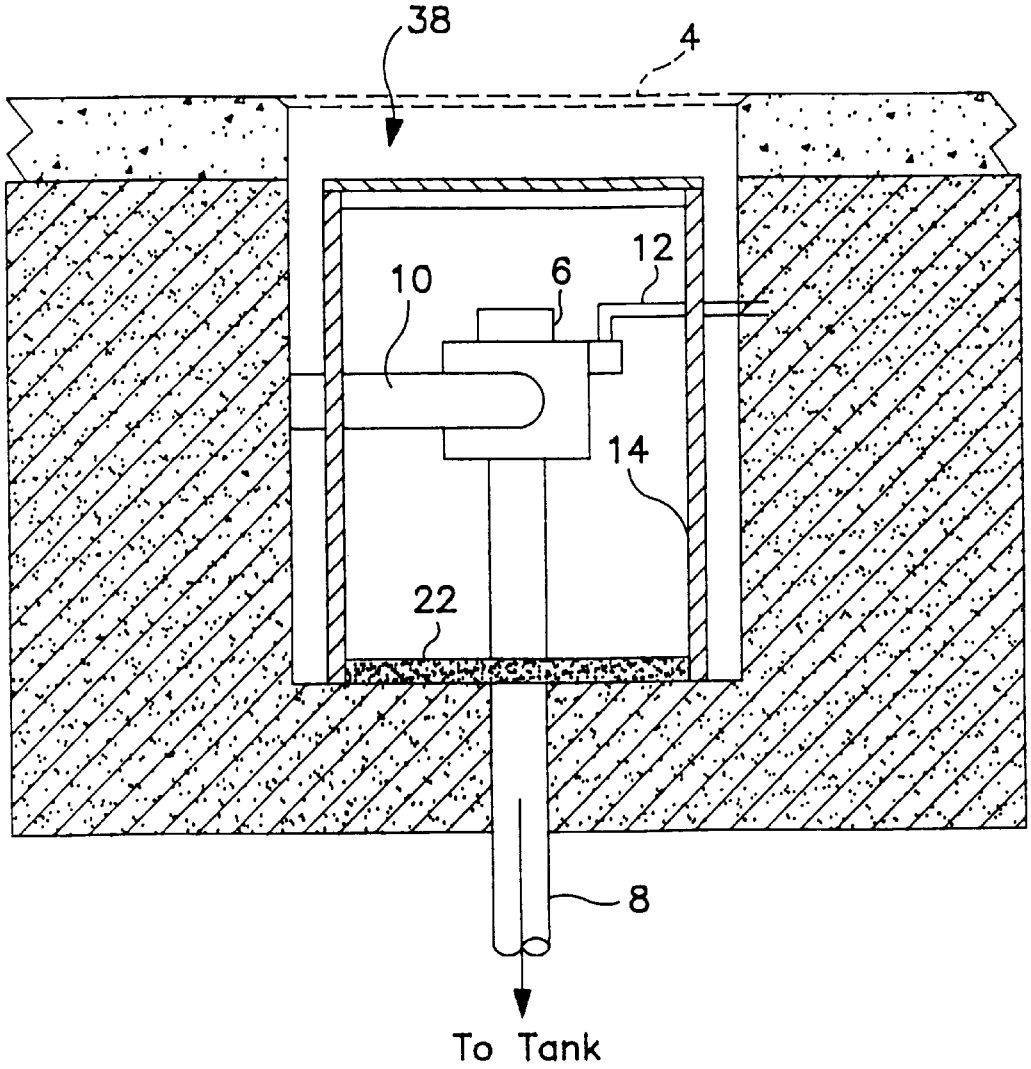
FIG. 8 shows a side view of the completed form in-place secondary containment system for a submersible pump sump.

The pipe section 16 is typically saw cut at one-third points around the diameter of the pipe section 16, as shown, for smaller diameters, and at one-fourth or even one-sixth points for larger diameters. The sections 14 are then slot cut before installing so that the pump discharge line 10 and the electrical power supply line 12 can penetrate the sump wall without being disconnected. The pump discharge line 10 and the electrical power supply line 12 penetrations are shown in FIG. 8. Vertical and/or horizontal slots are cut as needed to match the existing pump discharge line 10 and the electrical power supply line 12. For larger diameter pipes or longer slot cuts, connectors such as "H" channel closure or joiner strips 16 may be used to secure the residue slot material 18 around the pump discharge line 10 or electrical power supply line 12, as shown in FIGS. 4 and 6. The closure strips 16 may be of any suitable gasoline and other hydrocarbon resistant material, such as metal, plastic, high density polyethylene (HDPE) or FRP. Otherwise, a suitable gasoline and other hydrocarbon resistant elastomeric or polymeric sealant, such as Morton Thiokol T-2235-M, may be used to fill in the slot areas.

The sections or panels 14 are then placed in the sump area 2 and joined using a connector such as the closure strips 18 and sealed with a hydrocarbon and gasoline resistant elastomeric or polymeric material, such as Morton Thiokol T-2235-M. The sections 14 can also be banded around the outside of the fiberglass to add strength. The preferred embodiment is to leave a small space between the existing sump cavity retaining wall in the sump area 2 and the joined sections 14 and backfill this small annular space with gravel to match the existing backfill so that any water entering from the manhole 4 can drain into the ground. As described above, the residue slot material 20 taken out for the pump discharge line 10 and the electrical power supply line 12 are reshaped and installed with the sealant used to join the sections 14, and if needed, the closure strips 18. All openings for the penetrations and anything else must be sealed with the sealing material described above.

Figure 7:
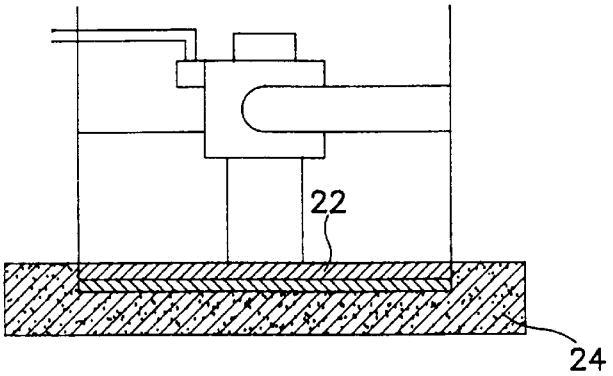
FIG. 7 shows the pour in-place floor used in the secondary containment system for the sump.

Once the side walls of the secondary containment system have been installed by so joining the sections 14, a pour in-place floor 22 is installed, as shown in FIG. 7. The preferred embodiment uses a process of spraying the pump head supply line with a primer such as Morton Thiokol TPR-415 to ensure good adhesion of the flooring material to a supporting ground surface 24 within the sump area 2. Then the floor 22, comprising a gasoline and other hydrocarbon resistant elastomeric or polymeric material, is applied to the ground surface 24 that will adhere to the joined sections 14 and the pump head supply line 8. The preferred material for the floor 22 is Morton-Thiokol RLP-2378G or RLP-2078, a two part, pourable polysulfide rubber system with excellent gasoline and hydrocarbon resistance. Another suitable material for the floor 22 is Morton-Thiokol T-2235-M.

Figure 9:
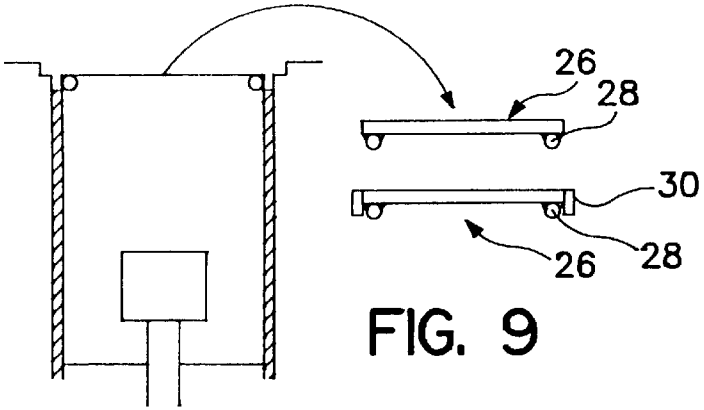

The new secondary containment system for the sump area 2 is then is fitted with a cover 26 to keep water from entering, as shown in FIG. 8. Although many designs may be used for the cover 26, designs that are particularly suitable for the cover 26 are shown in FIGS. 9 through 13. FIG. 9 shows the cover with an inflatable tube seal 28, bonded to the lower surface of the cover 26 to obtain a watertight seal. The tube seal 28 may be bonded to the lower surface of the cover 26 with a suitable gasoline and hydrocarbon resistant material, such as Morton Thiokol T-2235-M. Optionally, an outer ring or rim 30 may also be bonded to or formed in the lower surface of the cover 26 to provide extra sealing. The cover 26 itself is preferably a gasoline and hydrocarbon resistant material, such as RFP or polyethylene.

Figure 10:
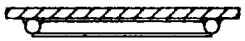
Figure 11:
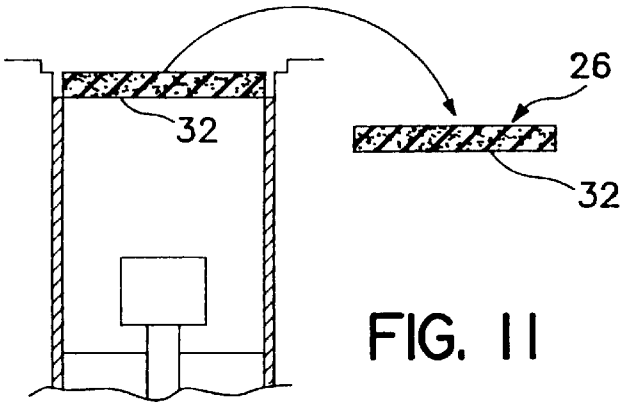

A variation of this design for the cover 26 is shown in FIG. 10, wherein a block 32 of a suitable material, such as polyethylene foam, is bonded on the lower surface of the cover 26 to brace and secure the tube seal 28. FIG. 11 shows another design, wherein the cover 26 comprises a block of a suitable material, such as polyethylene foam, that is cut in size to push into the top of the secondary containment system for the sump area 2.

Figure 12:
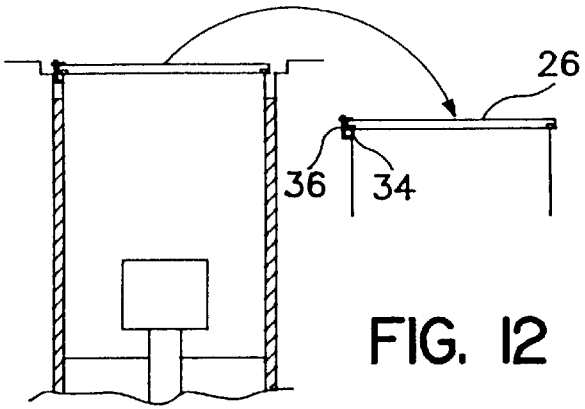
FIGS. 9 through 13 show a number of lid assembly options to prevent water entering the newly formed secondary containment system for the sump.
Figure 13:
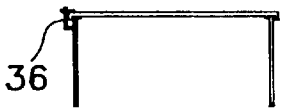

FIG. 12 shows yet another suitable design for the cover 26, wherein the lower surface of the cover 26 has an annular ridge 34 for receiving the upper edges of the joined sections 14 of the secondary containment system and complementary clamp or clamps 36 secure the cover 26 in place. FIG. 13 shows a slightly different design for the clamp or clamps 36.

The upgraded sump secondary containment assembly is now completed and the original manhole cover 4 is put back into place. FIG. 4 shows a side view of the completed form in-place submersible pump sump secondary containment assembly 38. The joined side sections 14 are shown along with the pour in-place floor 22. The new cover 26 keeps water from entering. The existing manhole cover 4 remains in place after the job is done.

Figure 14:
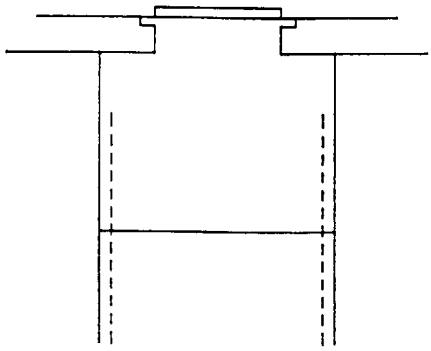
FIGS. 14 through 17 show the installation of the secondary containment system for the submersible pump sump in cases where the diameter of the existing manhole is less than that of the desired sump area.
Figure 15:
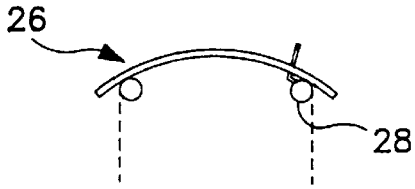
Figure 16:
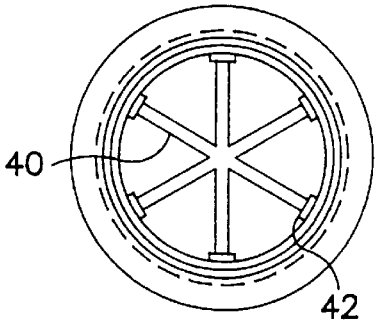
Figure 17:
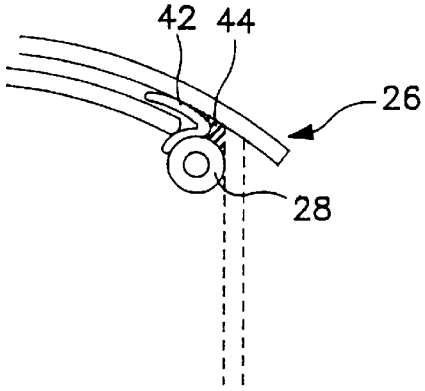

In some installations, the opening for the existing manhole cover 4 may be smaller in diameter than the desired sump area diameter, as shown in FIG. 14. In this instance, a collapsible cover 26 is desirable, such as the design shown in FIGS. 15 through 17. In this case, the cover 26 comprises a flexible gasoline and hydrocarbon resistant material, such as rubber treated cloth, held in shape by removable rigid stays 40 that are assembled within the tube seal 28 after the cover 26 is inserted through the existing manhole 4. Rubber coated cloth packets 42 are preferably attached to the ends of the stays 40 for cushioning. FIG. 17 shows a partial cross sectional view of the edge of the cover 26, showing one end of a stay 40, a cloth packet 42, the tube seal 28 and a rubber bond and seal 44 for the tube seal 28. After the cover 26 is assembled, the tube seal 28 is inflated and the cover 26 is put in place.

It should be noted that though the preferred embodiment is a round fiberglass pipe cut into sections, the invention is not limited to this. The sidewalls can be square if the original manhole entry is square and the sidewalls can be formed of alternative materials other than fiberglass. Because of the use of sectioned panels, the form in-place containment sump is often a larger diameter than the existing manhole opening. Alternately, if the existing manhole opening is of sufficiently large diameter, a round, single piece of pipe of the appropriate diameter may be used to form the sidewalls.

An alternative embodiment is to excavate the soil around the submersible pump head all the way to the underground storage tank. After cleaning the tank surface and the pipe entering the tank, the fiberglass panels are shaped in such a way as to sit on the top of the underground storage tank Panels would be assembled as describe above and the floor would be formed directly on the top of the underground storage tank. The sump would be completed as described above.

While only certain embodiments have been set forth, alternative embodiments and various modification will be apparent from the above description to those skilled in the art These alternatives are considered equivalents and within the spirit and scope of the present invention.

What is claimed is:

1. A method of containing spillage for a submersible pump system comprising the steps of:

selecting rigid sidewalls from a hydrocarbon and gasoline resistant group of rigid and semi-rigid thermosetting materials;

forming said rigid sidewalls around a submersible pump to form a tank-like structure;

sealing all penetrations from said tank-like structure with a material selected from a group of polymeric and elastomeric materials;

pouring a material selected from a group of elastomeric or polymeric materials over a floor surface of an existing sump area for said pump; and sealing a waterproof lid over said existing sump area.

2. The method set forth in claim 1, wherein said step of forming rigid sidewalls further comprises fitting multiple sections of said rigid sidewalls together with suitable connectors and fasteners.

3. The method set forth in claim 1, wherein said step of forming said rigid sidewalls further comprises forming said sidewalls from a single section of large diameter pipe.

4. The method set forth in claim 2, wherein said step of forming said rigid sidewalls comprises the step of selecting said multiple sections from fiberglass materials.

5. The method set forth in claim 4, wherein said step of forming said rigid sidewalls comprises the step of joining said multiple fiberglass sections with a thermosetting resin material.

6. A method of containing spillage for a submersible pump system comprising the steps of:

selecting multiple sections from fiberglass materials;

fitting multiple sections together with suitable connectors and fasteners to form rigid sidewalls;

forming said rigid sidewalls around a submersible pump to form a tank-like structure;

joining said multiple fiberglass sections with a thermosetting resin material;

sealing all penetrations from said tank-like structure with a material selected from a group of polymeric and elastomeric materials;

pouring a material selected from a group of elastomeric or polymeric materials over a floor surface of an existing sump area for said pump; and sealing a waterproof lid over said existing sump area.

* * * * *